US005349421A

United States Patent [19]

Kishimoto et al.

[11] Patent Number: 5,349,421

[45] Date of Patent: Sep. 20, 1994

[54] ELECTROPHOTOGRAPHING APPARATUS

[75] Inventors: Yasuhiro Kishimoto, Gifu; Kunio Tsuboi, Hyogo, both of Japan

[73] Assignee: Sanyo Electric Co., Ltd., Moriguchi, Japan

[21] Appl. No.: 126,500

[22] Filed: Sep. 24, 1993

[30] Foreign Application Priority Data

Sep. 25, 1992 [JP] Japan ..... 4-256417

[51] Int. Cl.[5] ..... G03G 15/00

[52] U.S. Cl. ..... 355/208; 355/228

[58] Field of Search ..... 355/208, 246, 228, 214

[56] References Cited

U.S. PATENT DOCUMENTS 4,378,153 3/1983 Nishimura et al. .

*Primary Examiner*—R. L. Moses

*Attorney, Agent, or Firm*—Darby & Darby

[57] ABSTRACT

An electrophotographing apparatus includes a photosensor for sensing or detecting a reflectance of an original, and an output voltage of the photosensor is sent to a microcomputer. In response to the output voltage of the photosensor, the microcomputer controls a bias voltage which is applied to an electric conductive substrate of a photoreceptor from a bias voltage source. The bias voltage is adjusted such that a change of an exposed voltage according to the reflectance of the original can be canceled, and resultingly, the exposed voltage is kept constant. On the other hand, a developer is connected to the ground, and therefore, a voltage difference between the exposed voltage and a developing voltage becomes constant.

10 Claims, 7 Drawing Sheets

ELECTROPHOTOGRAPHING APPARATUS

BACKGROUND OF THE INVENTION

1. Field of the invention

The present invention relates to an electrophotographing apparatus. More specifically, the present invention relates to an electrophotographing apparatus such as a copying machine, facsimile and etc., in which an electrostatic latent image is formed on a photoreceptor by exposing the photoreceptor, and then, developed with a toner.

2. Description of the prior art

A copying machine 1 that is one example of such a kind of prior art is shown in FIG. 7. In the copying machine 1, a light from a light source 6 is irradiated onto an original 5 put on an original table 4, and a photoreceptor 2 is exposed by a reflected light from the original 5, and therefore, an electrostatic latent image according to an original image is formed on the photoreceptor 2, and thereafter, the electrostatic latent image is toner-developed by a developer 3 to which a developing bias voltage Vb is applied.

At this time, in a case where the original 5 which is put on the original table 4 is an original having a low reflectance, such as a newspaper, a light amount of an exposure light irradiated onto the photoreceptor 2 is decreased, and therefore, an exposed voltage VL on the photoreceptor 2 becomes to be lowered, and accordingly, a background occurs if no countermeasure is taken.

In the prior art, in order to suppress the background, the light amount of the exposure light irradiated onto the photoreceptor 2 is kept constant by increasing the light amount of the light source 6 for exposing the original 5, so that the decrease of the exposed voltage VL is suppressed. More specifically, a reflectance of the original 5 is sensed or detected by a photosensor 7 such as a photodiode and etc., and a voltage applied to the light source 6, i.e. a voltage outputted from an AVR (Automatic Voltage Regurator) is changed in response to an output of the photosensor 7, whereby the light amount for exposing the original 5 can be changed so as to keep the light amount of the exposure light constant. In addition, if a developing bias voltage Vb applied to the developer 3 is made lower according to a drop of the exposed voltage VL, it is possible to prevent the background from occurring. In either case, an electric conductive substrate 2*a* of the photoreceptor 2 is connected to the ground.

Now, with referring to FIG. 8(A)–FIG. 8(C), the above described prior art is more specifically described. A voltage model at a time that a normal original having a white background is put on the original table 4 is shown in FIG. 8(A), and a voltage model at a time that an original having a background with lower reflectance is put on the original table 4 and no correction is taken for the light amount of the exposure light is shown in FIG. 8(B). It is understood that in a case of the original having a low reflectance shown FIG. 8(B), the light amount of the exposure light irradiated into the photoreceptor 2 is decreased, and therefore, the exposed voltage VL is dropped to −120 V from −40 V of a case of the original having a normal reflectance (FIG. 8(A)). In this example, because the developing bias voltage Vb is −140 V, the voltage difference between the developing bias voltage Vb and the exposed voltage VL is decreased to 20 V from 100 V, and therefore, the above described background occurs. Then, as shown in FIG. 8(C), the exposed voltage VL is kept at −40 V approximately by increasing the light amount of the light source 6 for exposing the original 5, or the developing bias voltage Vb is decreased to −280 V approximately, and therefore, the voltage difference between the developing bias Vb and the exposed voltage VL is kept at 100 V approximately such that the background can be suppressed.

However, if it is intended to suppress the background by suppressing the decrease of the exposed voltage VL by increasing the light amount of the light source 6 for exposing the original 5, a dark voltage Vd that is equal to an image portion of the original 5 is increased due to the increase of the light amount. More specifically, the dark voltage Vd is increased to −490 V from −540 V as shown in FIG. 8(A) and FIG. 8(B). Therefore, a voltage difference between the developing bias voltage Vb and the dark voltage Vd becomes small, and therefore, an image density is lowered. A similar or the same disadvantage occurs in a case where the background is suppressed by decreasing the developing bias voltage Vb.

SUMMARY OF THE INVENTION

Therefore, a principal object of the present invention is to provide a novel electrophotographing apparatus.

Another object of the present invention is to provide an electrophotographing apparatus in which a good image is obtainable.

An electrophotographing apparatus according to the present invention comprises: a photoreceptor including an electric conductive substrate; charging means for charging the photoreceptor at a predetermined voltage; exposing means for exposing the photoreceptor to form an electrostatic latent image on the photoreceptor; developing means for toner-developing the electrostatic latent image on the photoreceptor with a predetermined developing voltage; sensing means for sensing a reflectance of an original; and bias voltage applying means for applying a bias voltage which is changed in response to an output of the sensing means to the electric conductive substrate.

The reflectance of the original is sensed or detected by the sensing means such as a photodiode, and in response to the output of the sensing means, the bias voltage that is applied to the electric conductive substrate of the photoreceptor from the bias voltage applying means is changed. More specifically, if the reflectance of the original is changed, the exposed voltage is also changed; however, by changing the bias voltage applied to the electric conductive substrate such that a change of the exposed voltage can be canceled, the exposed voltage is kept constant. This utilizes a fact that a changing amount of the exposed voltage is changed according to the voltage difference between the bias voltage and the exposed voltage even if the same light amount of the exposure light is utilized. Furthermore, since the developing voltage of the developing means is constant, the difference between the exposed voltage and the developing voltage becomes constant, and therefore, no background occurs.

At this time, if the dark voltage is kept approximately constant by controlling the light amount from the light source, the voltage difference between the dark voltage and the developing voltage is also not changed, and therefore, no phenomenon that the image becomes thin due to the drop of the image density occurs.

In accordance with the present invention, it is possible to suppress the background as well as the decrease of the image density, and therefore, a good image can be obtained.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
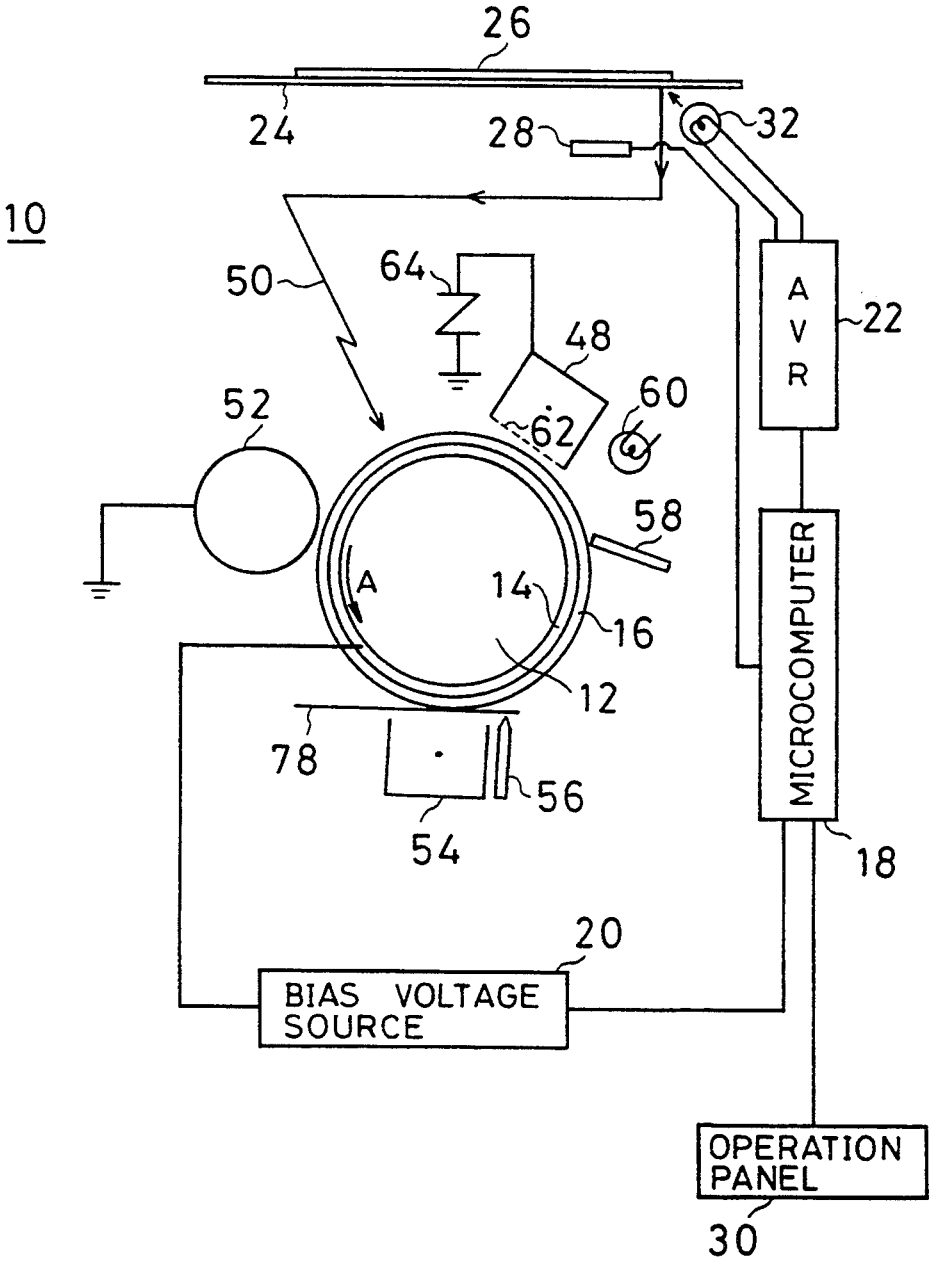
FIG. 1 is an illustrative view showing one embodiment according to the present invention.
Figure 2:
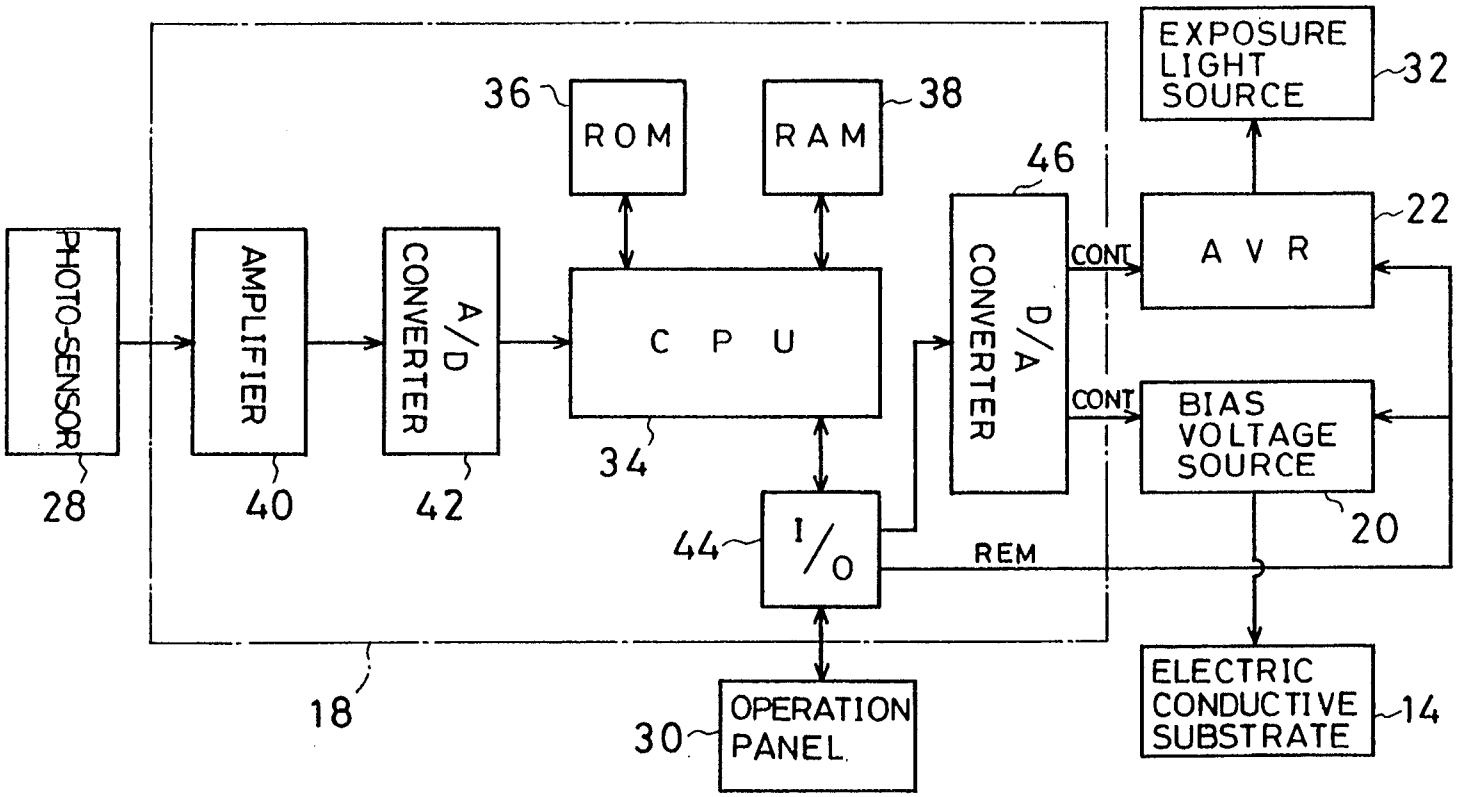
FIG. 2 is a block diagram showing a major portion of the embodiment.

With referring to FIG. 1 and FIG. 2, a copying machine 10 of this embodiment shown includes a photoreceptor 12. The photoreceptor 12 includes an electric conductive substrate 14 made of aluminum, for example, and a photosensitive layer 16 is formed on a surface of the electric conductive substrate 14. The photoreceptor 12 of this embodiment shown is charged with a negative polarity. An output terminal of a bias voltage source 20 which is controlled by a microcomputer 18 is connected to the electric conductive substrate 14. To the microcomputer 18, an AVR 22, a photosensor 28 for detecting or sensing a reflectance of an original 26 put on an original table 24, and an operation panel 30 including a start key and etc. are further connected. The AVR 22 is a power source for controlling a voltage applied to a light source 32 for exposing the original 26, and thus, a driver of the light source 32. In addition, the photosensor 28 is arranged below the original table 24, and when the original 26 put on the original table 24 is exposed by the light source 32, a portion of a reflected light that is reflected by the original 26 is received by the photosensor 28 so as to develop a voltage according to a magnitude of a light amount of the reflected light.

The microcomputer 18 includes a CPU 34, ROM 36 and RAM 38. In the ROM 36, the relationship between levels of the output voltage of the photosensor 28 and bias voltages Vp respectively corresponding to the output voltage levels are stored as a form of a output voltage level—bias voltage Vp table, and relationship between the levels of the output voltage of the photosensor 28, the bias voltages Vp and voltages applied to the light source 32 respectively corresponding to the output voltage levels are stored in a form of an output voltage level—bias voltage Vp—exposing voltage level table. That is, by the output voltage level—bias voltage Vp—exposing voltage level table, the relationship between the output voltage level of the photosensor 28, the bias voltage Vp and the exposing voltage can be determined. In the RAM 38, data inputted from the operation panel 30 and etc. are stored.

As the output voltage level—bias voltage Vp table, data indicated in the following table 1 are stored, and as the output voltage level—bias voltage Vp—exposing voltage level table, data indicated in the following table 2 are stored.

TABLE 1

(case where only the bias voltage Vp is changed)

| output voltage level of photosensor 28 | 1 | 2 | 3 | 4 | 5 |
|---|---|---|---|---|---|
| bias voltage Vp | +300V | +260V | +220V | +180V | +140V |

TABLE 2

(case where the bias voltage Vp and the exposing voltage are changed)

| output voltage level of photosensor 28 | 1 | 2 | 3 | 4 | 5 |
|---|---|---|---|---|---|
| bias voltage Vp | +300V | +260V | +220V | +180V | +140V |
| exposing voltage level | +4 | +3 | +2 | +1 | ±0 |

In the table 1 and the table 2, a light amount sensed or detected by the photosensor 28 becomes larger as the output voltage level of the photosensor 28 is changed from "1" to "5". In addition, in the table 2, the light amount from the light source 32 becomes larger as the exposing voltage level is changed from "±0" to "+4".

Returning to FIG. 2 and FIG. 1, the microcomputer 18 further includes an amplifier 40 for amplifying the output voltage from the photosensor 28, an A/D converter 42 for converting an output from the amplifier 40 into digital data, an I/O interface 44 for connecting the CPU 34 to exterior elements, and a D/A converter 46 for converting digital data from the I/O interface 44 into a control signal CONT that is an analog voltage.

Around the photoreceptor 12, a charger 48, an exposing light path 50, a developer 52, a transferor 54, a separator 56, a cleaning blade 58, an erasure lamp 60 and etc. are arranged in a rotation direction of the photoreceptor shown by an arrow mark A.

The charger 48 includes a mesh-like grid electrode 62 which is connected to the ground via a varistor 64 which functions as a hi-directional constant voltage diode. A so-called varistor voltage of the varistor 64 is set at approximately 400 V, and therefore, the surface voltage Vo of the photoreceptor 12 is controlled as approximately −400 V. At this time, the dark voltage Vd that shows a value approximately near the surface voltage Vo also becomes −400 V.

By irradiating an original image through the exposing light path 50 onto the photoreceptor 12 that has been uniformly charged by the charger 48, an electrostatic latent image according to a photoelectric conductive characteristic of the photoreceptor 12 is formed on the photoreceptor 12.

More specifically, if the original 26 is exposed by the light source 32 to which a predetermined constant voltage adjusted by the AVR 22 is applied, the reflected light according to the reflectance of the original 26 is irradiated into the photosensor 28. In accordance with the light amount of the reflected light, it is possible to presume the reflectance of the original 26. The photosensor 28 applies the output voltage according to the light amount of the reflected light to the CPU 34 as the data of the reflectance of the original 26 via the amplifier 40 and the A/D converter 42 included in the microcomputer 18.

The CPU 34 reads the data of the bias voltage Vp according to the output voltage of the photosensor 28 with referring to the output voltage level—bias voltage Vp table (table 1) stored in the ROM 36, and the data is applied to the bias voltage source 20 as the control signal CONT via the I/O interface 44 and the D/A converter 46. Accordingly, the bias voltage Vp according to the control signal CONT is applied from the bias voltage source 20 to the electric conductive substrate 14 of the photoreceptor 12.

Furthermore, with referring to the output voltage level—bias voltage Vp—exposing voltage level table (table 2) stored in the ROM 36, the CPU 34 performs the signal conversion and etc. similar to the above described the output voltage level—bias voltage Vp table (Table 1) for the bias voltage Vp, and reads data of the exposing voltage level according to the output voltage of the photosensor 28, and the data is applied to the AVR 22 as a control signal CONT via the I/O interface 44 and the D/A converter 46.

The voltage applied to the light source 32 is controlled in accordance with the control signal CONT, and therefore, the light amount of the light source 32 for exposing the original 26 can be adjusted. At this time, remote signals REM each of which is a low level are applied to the AVR 22 and the bias voltage source 20 from the I/O interface 44. Thus, under a condition that is determined by a proper bias voltage Vp and the light source voltage applied to the light source 30 respectively according to the original 26, the photoreceptor 12 that has been uniformly charged is exposed such that the electrostatic latent image is formed on the photoreceptor 12.

Figure 3:
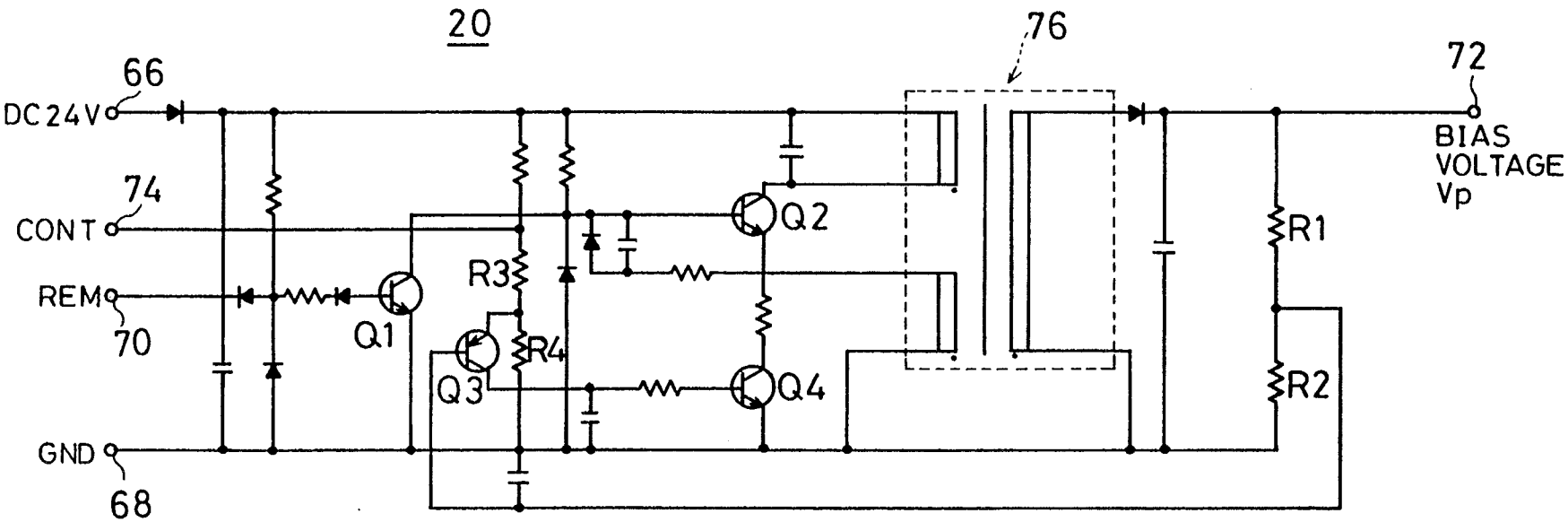
FIG. 3 is a circuit diagram showing one example of a bias voltage source.

Now, the bias voltage source 20 will be described with referring to FIG. 3. In FIG. 3, a power source voltage of DC 24 V, for example, for driving the bias voltage source 20 is applied to a terminal 66. A terminal 68 is connected to the ground. In addition, the remote signal REM is inputted from a terminal 70. The remote signal REM is a signal for controlling the on/off of the bias voltage Vp outputted from a terminal 72, and the bias voltage Vp is outputted when the remote signal REM is low level (approximately 0 V), and no bias voltage Vp is outputted when the remote signal REM is the high level (approximately 5–10 V). Furthermore, the control signal CONT is inputted from a terminal 74, which controls an output value of the bias voltage Vp. The bias voltage Vp is changed from 100 V to 400 V as the control signal CONT is changed from 0 V to 12 V. However, such the output value can be arbitrarily predetermined.

In an operation of the bias voltage source 20, when the remote signal REM becomes the low level, a base voltage of a transistor Q1 also becomes the low level, no collector current flows in the transistor Q1. Therefore, a collector voltage of the transistor Q1 becomes the high level and a base voltage of a transistor Q2 also becomes the high level. When the base voltage of the transistor Q2 becomes the high level, the transistor Q2 is turned-on, and therefore, a collector current and an emitter current flow in the transistor Q2.

On the other hand, when the bias voltage Vp has not been outputted, a feed-back voltage, i.e. a terminal voltage of a resistor $R2=R2/(R1+R2)$, being voltage-divided by the resistor R1 and the resistor R2, is 0 V, and therefore, a base voltage of the transistor Q3 becomes the low level. Since the transistor Q3 is turned-on at a time that the base voltage thereof is the low level, an emitter current and a collector current flow through the transistor Q3. If the collector current of the transistor Q3 flows, a transistor Q4 is turned-on, and therefore, a collector current and an emitter current of the transistor Q4 flow. Thus, collector currents flow through the transistors Q2 and Q4, respectively, and therefore, a current flows at a primary side of a transformer 76, and accordingly, a transformed voltage, that is, the bias voltage Vp is developed at a secondary side. When the bias voltage Vp becomes more than a predetermined value, the feed-back voltage applied to a base of the transistor Q3 becomes the high level, the transistor Q3 is turned-off, and no current flows between an emitter and a collector of the transistor Q3, and therefore, the bias voltage Vp drops. Thus, by controlling the base voltage of the transistor Q3 at the high level or the low level, that is, by controlling the turning-on/off of the transistor Q3, the bias voltage Vp is controlled constant.

In addition, through comparison respective terminal voltages of resistors R3 and R4 with each other, it is determined whether the base voltage of the transistor is the high level or the low level. The respective terminal voltages of the resistors R3 and R4 are determined by the control signal CONT that is controlled by the CPU 34. Therefore, it is possible to control the base voltage of the transistor Q3 at the high level or the low level by the control signal CONT, and therefore, the bias voltage Vp outputted from the terminal 72 can be controlled.

Returning to FIG. 1, the electrostatic latent image formed on the photoreceptor 12 is developed by the developer 52. The developer 52 includes a developing agent in which a toner and a carrier are mixed, a magnet roller and etc. as well known. The magnet roller includes a magnet arranged within a cylindrical developing sleeve which is faced to the photoreceptor 12, and the developing agent is fed on the developing sleeve. The toner is charged with a positive polarity by mixing the carrier, and adhered onto a portion of the electrostatic latent image that is charged with a negative polarity at a portion where the developing sleeve and the photoreceptor 12 are faced to each other. Thus, the electrostatic latent image is toner-developed. In addition, the developing sleeve, that is, the developer 52 is connected to the ground such that the developing voltage can be set as 0 V.

The transferor 54 transfers a toner image developed on the photoreceptor 12 onto a paper 78 fed from a left side of FIG. 1. More specifically, by applying a DC corona discharge of a negative polarity to the paper 78 at a back side of the paper 78 by the transferor 54, the toner on the photoreceptor 12 is absorbed by an electric field such that the toner image can be transferred onto the paper 78. A DC corona discharge of a positive polarity is applied to the paper 78 on which the toner image has been transferred by the separator 56 such that the charge of the negative polarity applied by the transferor 54 is neutralized, the paper 78 is separated from the photoreceptor 12. The paper 78 on which the toner image has been transferred is fed to a fixing device (not shown) and the toner image is fixed onto the paper 78 by the fixing device.

The cleaning blade 58 collects a toner that has not been transferred onto the paper 78 and remains on the photoreceptor 12. The erasure lamp 60 eliminates a residual charge of the photoreceptor 12. Thereafter, the photoreceptor 12 is uniformly charged again by the charger 48. By repeating such an electrophotographing process, an image can be formed on the paper.

Figure 4:
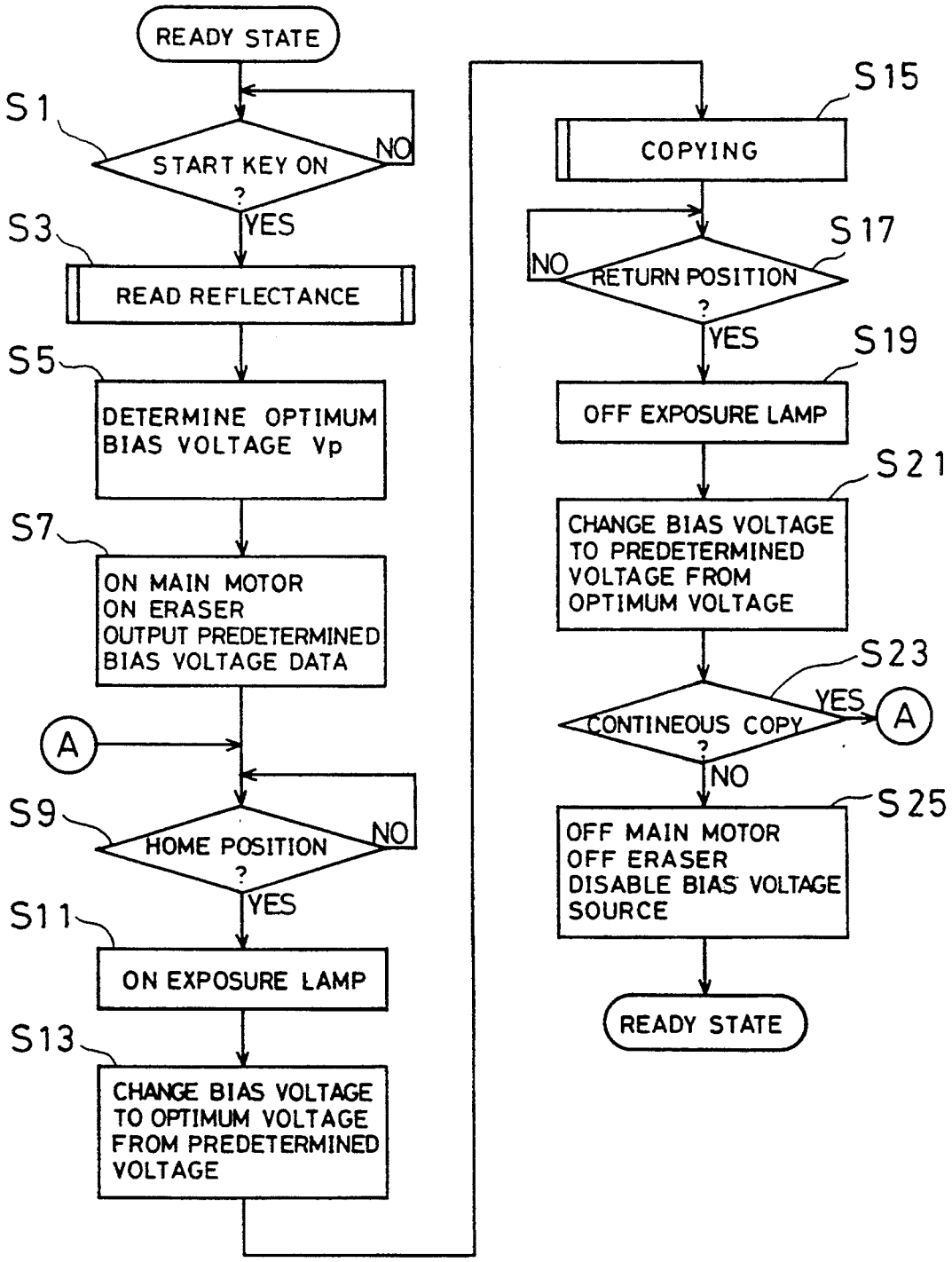
FIG. 4 is a flowchart showing an operation of the embodiment.

In an operation of such the copying machine 10, at first, in a step S1 shown in FIG. 4, it is determined whether or not the start key included in the operation panel 30 is turned-on. A stand-by state continues until the start key is turned-on, and when the start key is turned-on, the process proceeds to a step S3. In the step S3, tile microcomputer 18 reads the reflectance data of the original 26 by the above described method, and thereafter, the process proceeds to a step S5. In the step S5, a proper value of the bias voltage Vp that is utilized in a step S13 is determined on the basis of the reflectance of the original 26, that is, the output voltage of the photosensor 28 according to the light amount of the reflected light. At this time, the output voltage level—bias voltage Vp table (table 2) is referred by the microcomputer 18. Then, in a step S7, a main motor (not shown) and the erasure lamp 60 are turned-on, and the bias voltage Vp of the predetermined value is outputted. The bias voltage Vp of this embodiment is equal to +140 V in FIG. 5.

Next, in a step S9, it is determined whether or not a scanner (not shown) reaches a home position. That is, it is determined whether or not a tip end of the original 26 is detected by the scanner. When the scanner reaches the home position, the process proceeds to a step S11 wherein the original 26 is exposed by the light source 32 to which the predetermined constant light source voltage is applied. Next, in the step S13, the bias voltage Vp is changed to a proper value determined by the step S3, and the process proceeds to a step S15. In the step S15, a sequence of copying processes such as the developing, transferring, and etc. are performed. Then, in a step S17, it is determined whether or not the scanner reaches a return position. This judgment is performed on the basis of whether or not an end of the original 26 is detected by the scanner. If the scanner reaches the return position, in a step S19, the light source 32 is turned-off. Thereafter, in a step S21, the bias voltage Vp is changed to a predetermined value (+140 V), and in a step S23, it is determined whether or not a copy is to be performed continuously. If a continuous copy, the process is returned to the step S9, and if not continuous copy, in a step S25, the main motor and the erasure lamp 60 are turned-off, and the bias voltage Vp is set as 0 V.

In such the operation, when the scanner exists between the home position and the return position, the scanning operation of the copy sequence is performed, and the bias voltage Vp to be applied to the electric conductive substrate 14 of the photoreceptor 12 during the scanning operation must be the proper value that is determined in the step S3 and corresponding to the reflectance of the original 26. On the other hand, the copying processes other than the scanning operation have nothing to do with the original 26 directly, and therefore, the bias voltage Vp of the predetermined value +140 V may be applied to the electric conductive substrate 14.

Figure 5A:
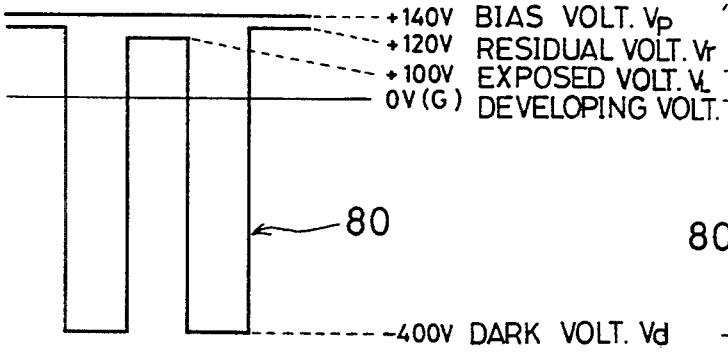
FIGS. 5A & B are an illustrative view showing a voltage model at a surface of a photoreceptor in a case where only a bias voltage is changed.
Figure 5B:
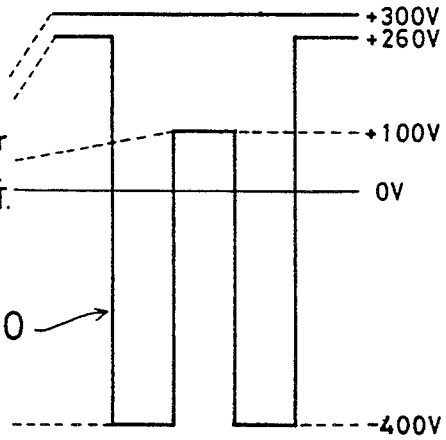

FIG. 5 shows a voltage model of the photoreceptor 12 of the copying machine 10 of this embodiment shown. A voltage model of a case where a normal original having a white background is put on the original table 24 is shown in FIG. 5(A), and a voltage model of a case where an original having a low reflectance is put on the original table 24 is shown in FIG. 5(B). In addition, a solid line designated by an arrow mark 80 is representative of a change of the surface voltage of the photoreceptor 12. Through comparison of FIG. 5(A) and FIG. 5(B) with each other, it will be understood that in a case of the original 26 having a low reflectance, the bias voltage Vp which is determined on the basis of the output voltage of the photosensor 28 and applied to the electric conductive substrate 14 of the photoreceptor 12 by the bias voltage source 20 is changed to 300 V (the proper value) from 140 V (the predetermined value) of a case of the normal original, whereby the exposed voltage VL of the photoreceptor 12 can be kept constant at 100 V. In other words, if the reflectance of the original 26 is changed, the exposed voltage VL is also changed; however, by changing the bias voltage Vp applied to the electric conductive substrate 14 such that a changing amount of the exposed voltage VL can be canceled, it is possible to keep the exposed voltage VL constant in respect to an original having an arbitrary reflectance. This utilizes a fact that the changing amount of the exposed voltage VL is changed according to the voltage difference between the bias voltage Vp and the exposed voltage VL even if the same light amount of the exposure light is utilized. At this time, since the developer 36 is connected to the ground and thus the developing voltage is also kept constant at 0 V, the voltage difference between the exposed voltage VL and the developing voltage is also kept constant, and therefore, no background occurs. In addition, the residual voltage Vr is changed from 120 V to 260 V. The residual voltage Vr means the surface voltage of the photoreceptor 12 after the residual charge is eliminated by the erasure lamp 60 until the photoreceptor 12 is charged again by the charger 48.

Furthermore, since the light amount of the light source 30 for exposing the original 26 is constant, the dark voltage Vd of the photoreceptor 12 is also kept constant at −400 V, and the voltage difference between the dark voltage Vd and the developing voltage is can be kept constant. Therefore, there occurs no disadvantage that the image becomes thin due to the drop of the image density.

Figure 6A:
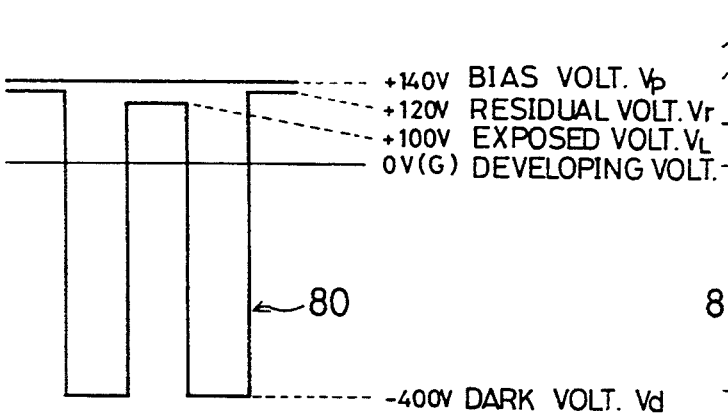
FIGS. 6A & 6B are an illustrative view showing a voltage model at the surface of the photoreceptor in a case where the bias voltage and a light source voltage are changed.
Figure 6B:
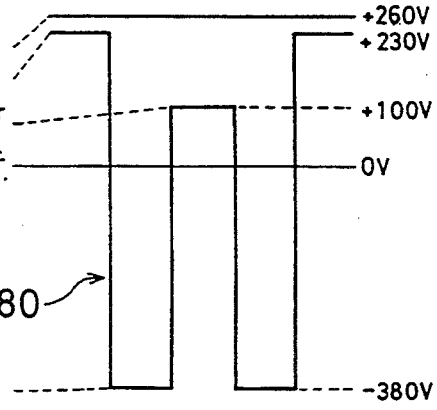
Figure 7:
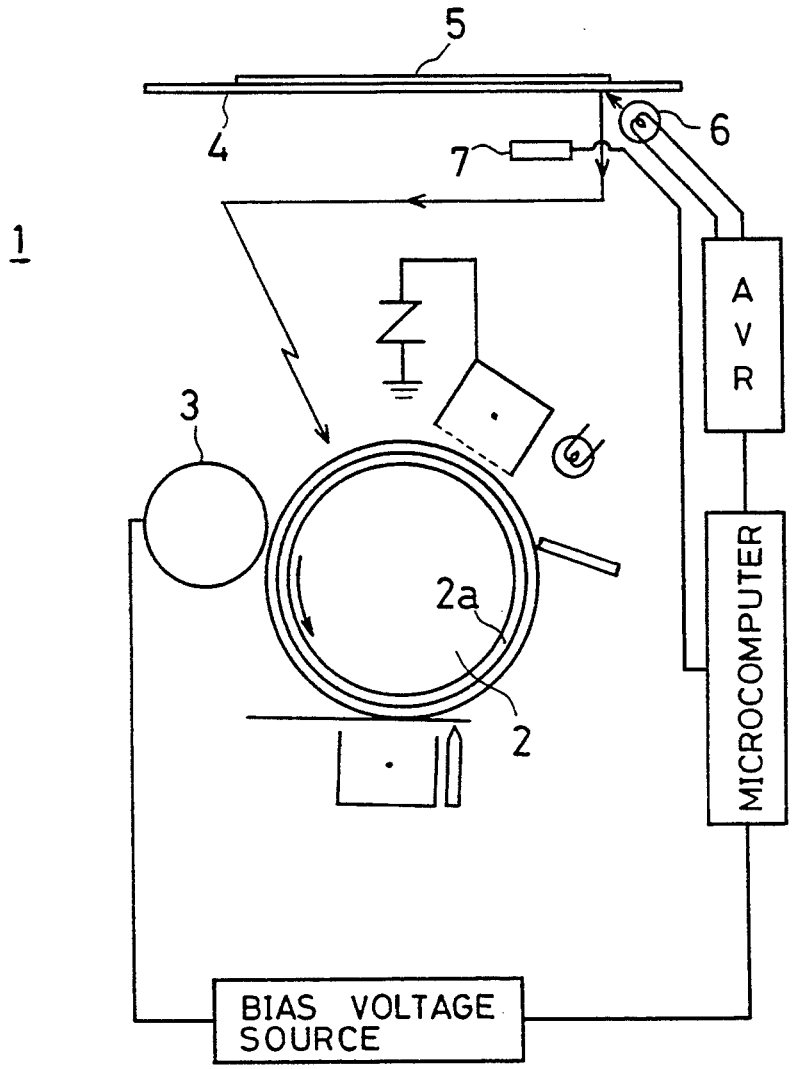
FIG. 7 is an illustrative view showing a prior art.
Figure 8A:
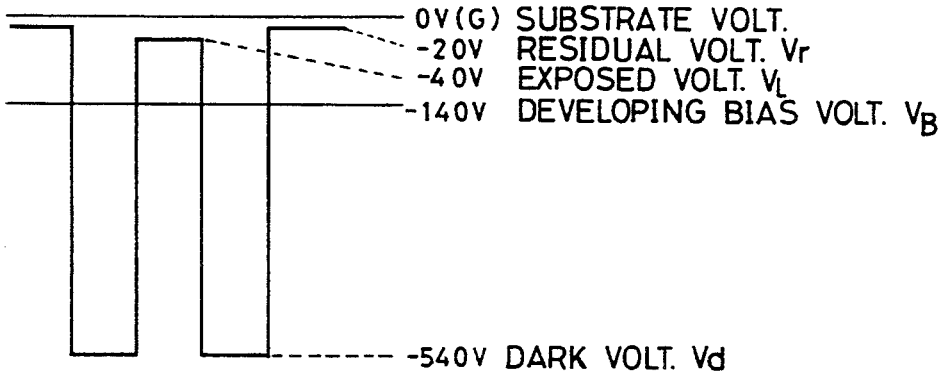
FIGS. 8A, 8B, an 8C are an illustrative view showing a voltage model at a surface of a photoreceptor in the prior art.
Figure 8B:
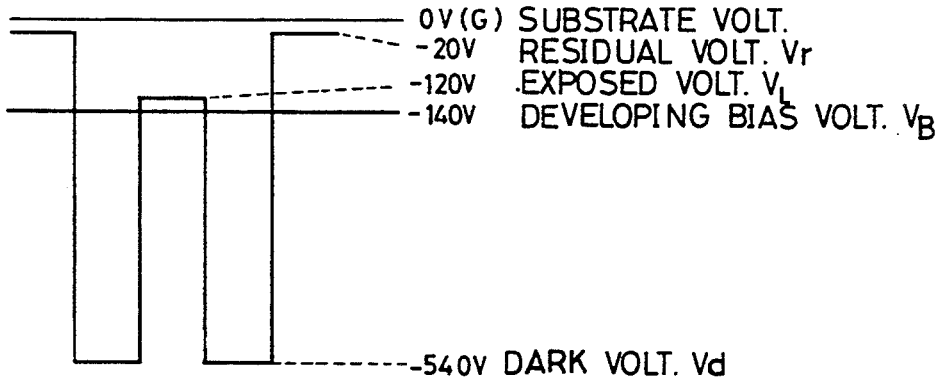
Figure 8C:
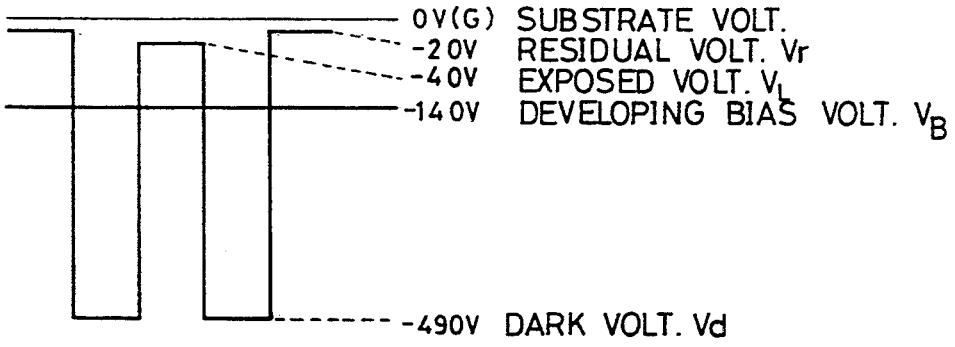

Furthermore, if not only the bias voltage Vp applied to the electric conductive substrate 14 but also the light amount of the exposure light irradiated onto the photoreceptor 12 by changing the light amount of the light source 32 are controlled in accordance with the reflectance of the original 26 by using the table 2, it is possible to make the increase of the bias voltage Vp small as shown in FIG. 6. More specifically, as seen from FIG. 6(A) and FIG. 6(B), the bias voltage Vp is increased from 140 V to 260 V, and therefore, it is not necessary to increase the bias voltage Vp to 300 V shown in FIG. 5(B). Therefore, it is possible to obtain an image without the background in spite of an original having a lower reflectance, and therefore, the present invention can be applied to an original having a wide range of the reflectance. In addition, it is to be noted that the light amount of the light source 30 is changed such that the dark voltage Vd becomes constant. As seen from FIG. 6(A) and FIG. 6(B), in this case, the dark voltage Vd is slightly changed from −400 V to −380 V, being kept constant approximately. Therefore, the voltage difference between the dark voltage Vd and the developing voltage is also kept constant approximately, there is no disadvantage that the image becomes thin due to the drop of the image density.

In addition, as the photoreceptor 12, a photoreceptor which is charged with a positive polarity may be utilized, and a material of the photosensitive layer 16 may be an organic photosensitive material or an inorganic photosensitive material. Furthermore, the photoreceptor 12 is a photosensitive drum in the above described embodiment; however, a photosensitive belt and etc. may be utilized as the photoreceptor 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographing apparatus, comprising:

a photoreceptor including an electric conductive substrate;

charging means for charging said photoreceptor at a predetermined voltage;

exposing means for exposing said photoreceptor to form an electrostatic latent image according to an original on said photoreceptor;

developing means for toner-developing said electrostatic latent image on said photoreceptor with a predetermined developing voltage;

reflectance sensing means for sensing a reflectance of said original; and bias voltage applying means for applying a bias voltage that is changed in response to an output of said reflectance sensing means to said electric conductive substrate.

2. An electrophotographing apparatus according to claim 1, further comprising means for keeping said developing voltage of said developing means constant.

3. An electrophotographing apparatus according to claim 2, wherein said means includes means for connecting said developing means to the ground.

4. An electrophotographing apparatus according to claim 2, further comprising exposure light amount controlling means for controlling a light amount of an exposure light from said exposing means in response to the output of said reflectance sensing means.

5. An electrophotographing apparatus according to claim 4, wherein said exposing means includes a light source for irradiating a light onto said original and driving means for driving said light source, and said exposure light amount controlling means controls a driving voltage applied to said light source from said driving means.

6. An electrophotographing apparatus according to claim 2, wherein said bias voltage applying means includes a microcomputer for receiving the output of said reflectance sensing means and for outputting a value of the bias voltage according to the output, and a bias voltage source for applying the bias voltage according to an output value of said microcomputer to said electric conductive substrate.

7. An electrophotographing apparatus according to claim 6, wherein said microcomputer includes a first memory for storing a first table representative of relationship between the output of said reflectance sensing means and said bias voltage, and determines said output value with referring to said first table.

8. An electrophotographing apparatus according to claim 4, wherein said exposure light amount controlling means includes a microcomputer for receiving the output of said reflectance sensing means and for outputting a value of said driving voltage according to the output, and means for applying a control voltage according to the output value of said microcomputer to said driving means.

9. An electrophotographing apparatus according to claim 8, wherein said microcomputer includes a second memory for storing a second table representative of relationship between the output of said reflectance sensing means and said driving voltage, and determines said output value with referring to said second table.

10. An electrophotographing apparatus, comprising:

a photoreceptor including an electric conductive substrate;

bias voltage applying means for applying a bias voltage to said electric conductive substrate;

charging means for charging said photoreceptor at a predetermined voltage;

exposing means for exposing said photoreceptor to form an electrostatic latent image according to an original on said photoreceptor;

developing means for toner-developing said electrostatic latent image on said photoreceptor with a predetermined developing voltage;

reflectance sensing means for sensing a reflectance of said original; and bias voltage changing means for changing said bias voltage in response to an output of said reflectance sensing means.

* * * * *